US010175621B2

(12) United States Patent
Konishi et al.

(10) Patent No.: US 10,175,621 B2
(45) Date of Patent: Jan. 8, 2019

(54) FIXING DEVICE AND IMAGE FORMING APPARATUS

(71) Applicant: FUJI XEROX CO., LTD., Tokyo (JP)

(72) Inventors: Yoshiro Konishi, Kanagawa (JP); Jun Sawamura, Kanagawa (JP); Hideki Sato, Kanagawa (JP); Takayuki Ukawa, Kanagawa (JP); Yasuhiro Kato, Kanagawa (JP); Masahiro Akatsuka, Kanagawa (JP); Yusuke Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/792,757

(22) Filed: Oct. 25, 2017

(65) Prior Publication Data

US 2018/0203385 A1 Jul. 19, 2018

(30) Foreign Application Priority Data

Jan. 16, 2017 (JP) ..... 2017-004967

(51) Int. Cl.
*G03G 21/20* (2006.01)
*G03G 15/20* (2006.01)

(52) U.S. Cl.
CPC ..... *G03G 15/2053* (2013.01); *G03G 15/206* (2013.01); *G03G 15/2025* (2013.01); *G03G 15/2028* (2013.01); *G03G 2215/2009* (2013.01)

(58) Field of Classification Search
CPC ..... G03G 15/2053; G03G 15/2064; G03G 15/2075; G03G 15/2085; G03G 15/2089; G03G 15/206; G03G 15/2025; G03G 15/2028; G03G 2215/2009
See application file for complete search history.

(56) References Cited

U.S. PATENT DOCUMENTS 8,693,936 B2 4/2014 Nanno et al.
2010/0284715 A1* 11/2010 Yagi ..... G03G 15/2053 399/329

FOREIGN PATENT DOCUMENTS

JP 2012145715 8/2012

* cited by examiner

*Primary Examiner* — Hoang Ngo
(74) *Attorney, Agent, or Firm* — JCIPRNET

(57) ABSTRACT

A fixing device includes a roller member that rotates and a belt member including an endless belt that moves circularly while being in contact with the roller member, a pressing member that is disposed in a space enclosed by the endless belt and that presses the endless belt against the roller member on both a downstream side and an upstream side relative to a direction of rotation of the roller member, and a rotation hindering member that is disposed in the space enclosed by the endless belt and that hinders the pressing member from rotating as a result of receiving a reaction force. The roller member and the endless belt nip a sheet that has been transported while holding a toner image on the sheet and cause the sheet to pass between the roller member and the endless belt, so that the toner image is fixed onto the sheet.

18 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-004967 filed Jan. 16, 2017.

BACKGROUND

(i) Technical Field

The present invention relates to a fixing device and an image forming apparatus.

(ii) Related Art

A known example of a fixing device that fixes an unfixed toner image formed on a sheet onto the sheet by applying heat and pressure to the toner image is a fixing device including a roller member that rotates and a belt member that includes an endless belt and that allows a sheet to pass between the endless belt and the roller member by nipping the sheet therebetween. In a configuration in which an endless belt is pressed against a roller member, the size of a region (so-called nip region) in which a sheet that passes between the endless belt and the roller member is heated and pressurized while being nipped therebetween may be further increased in a sheet-transport direction compared with a configuration in which two roller members are pressed against each other, and consequently, this configuration is advantageous for increasing the speed of sheet transportation and for improving productivity of image formation.

Here, the nip pressure (the pressure at which the endless belt is pressed against the roller member) at the start of the nip region where a sheet enters may be set to be low in order to reduce the resistance generated when the sheet enters the nip region, and the nip pressure at the end of the nip region where the sheet is ejected may be set to be high in order to prevent the sheet from being wrapped around the roller member and the like.

SUMMARY

According to an aspect of the invention, there is provided a fixing device including a roller member that rotates and a belt member that includes an endless belt that moves circularly while being in contact with the roller member, a pressing member that is disposed in a space enclosed by the endless belt and that presses the endless belt against the roller member on both a downstream side and an upstream side relative to a direction of rotation of the roller member, and a rotation hindering member that is disposed in the space enclosed by the endless belt and that hinders the pressing member from rotating as a result of receiving a reaction force. The roller member and the endless belt nip a sheet that has been transported while holding a toner image on the sheet and cause the sheet to pass between the roller member and the endless belt, so that the toner image on the sheet is fixed onto the sheet.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Figure 1:
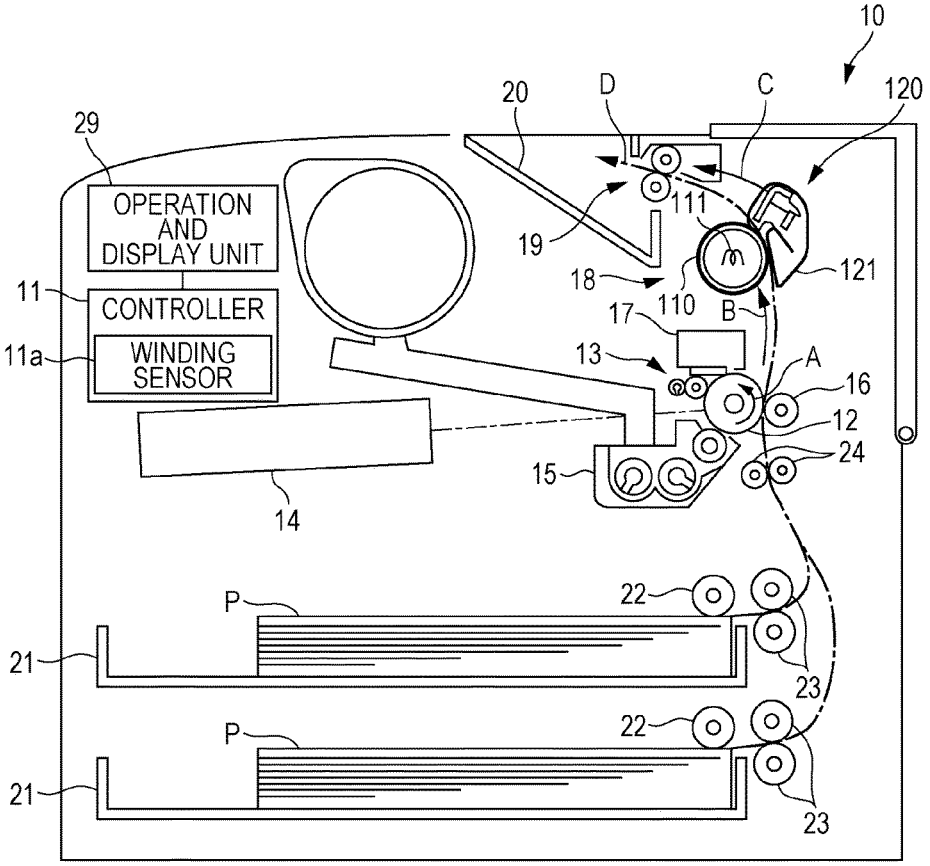
FIG. 1 is a schematic diagram of a printer that is an image forming apparatus according to an exemplary embodiment of the present invention.

FIG. 1 is a schematic diagram of a printer that is an image forming apparatus according to the exemplary embodiment of the present invention.

A printer 10 illustrated in FIG. 1 is a black-and-white printer and an image signal representing an image, the image signal being generated by an apparatus such as, for example, a personal computer that is different from the printer 10, is input to the printer 10 via a signal cable (not illustrated) or the like. The printer 10 includes a controller 11 that controls the operation of each component of the printer 10, and an image signal is input to the controller 11. The printer 10 performs image formation based on an image signal under control of the controller 11.

The controller 11 has a function of serving as an information processing apparatus that includes a central processing unit (CPU) that runs a program, a memory, and the like. In the printer 10, an image forming operation is controlled as a result of the controller 11 running a control program.

The printer 10 includes an operation-and-display unit 29 provided on or in an outer wall surface of the printer 10. The operation-and-display unit 29 performs various operations including switching on and off of the printer 10 and various displays including display of the state (e.g., now printing, printing completed) of the printer 10.

The printer 10 includes sheet trays 21 that are disposed in a lower portion thereof, and sheets P are stacked on top of one another in the sheet trays 21. The sheet trays 21 are configured to be capable of being drawn out to be supplied with the sheets P. There is a case where the size of each of the sheets P to be accommodated in the sheet trays 21 is changed by a user, and in addition, there is a case where the sheets P having different sizes and different thicknesses are accommodated in the plural sheet trays 21. The controller 11 recognizes the sizes and the thicknesses of the sheets P that are actually accommodated in the sheet trays 21 and uses the information regarding the sizes and the thicknesses for controlling each unit of the printer 10. Although not illustrated, a mechanism of automatic recognition using a sensor or the like or a mechanism of recognition in accordance with an input from a user or the like, the mechanism being required for the controller 11 to recognize the sizes and the thicknesses of the sheets P, is incorporated within the printer 10.

One of the sheets P in one of the sheet trays 21 is delivered to standby rollers 24 by a corresponding one of pickup rollers 22 and a corresponding pair of separation rollers 23. The timing of transportation of the sheet P, which has reached the standby rollers 24, is adjusted, and the sheet P is further transported.

The printer 10 includes a photoconductor 12 that has a cylindrical shape and rotates in the direction of arrow A, and a charger 13, an exposure unit 14, a developing unit 15, a transfer unit 16, and a photoconductor cleaner 17 are disposed around the photoconductor 12. A combination of the photoconductor 12, the charger 13, the exposure unit 14, the developing unit 15, and the transfer unit 16 corresponds to an example of a toner-image forming unit according to the exemplary embodiment of the present invention.

The charger 13 charges a surface of the photoconductor 12, and the exposure unit 14 exposes the surface of the photoconductor 12 to light in accordance with an image signal, which is sent from the controller 11, so as to form an electrostatic latent image. The electrostatic latent image is developed by the developing unit 15, and as a result, a toner image is formed.

The above-mentioned standby rollers 24 send out one of the sheets P in such a manner that the sheet P reaches a position facing the transfer unit 16 in accordance with the timing at which a toner image formed on the photoconductor 12 reaches the position. Then, the toner image formed on the photoconductor 12 is transferred onto the sheet P, which has been sent out, by operation of the transfer unit 16. As a result, an unfixed toner image is formed on the sheet P.

The sheet P, on which the unfixed toner image has been formed, is further transported in the direction of arrow B, and the toner image is fixed onto the sheet P by being heated and pressurized when the sheet P passes through a fixing unit 18. The fixing unit 18 includes a heating roller 110 and a pressure belt 120. The heating roller 110 includes a heat source 111 therein. The pressure belt 120 includes a pressing member 122 and a rotation hindering member 123 (see FIG. 2), and the pressing member 122 presses an endless belt 121 against the heating roller 110. The sheet P that passes through the fixing unit 18 passes through a nip region N (see FIG. 2) that is defined by the heating roller 110 and the pressure belt 120 of the fixing unit 18. As a result, an image, which is formed of the fixed toner image, is formed on the sheet P. The fixing unit 18 corresponds to a fixing device according to the exemplary embodiment of the present invention.

The sheet P, which has passed through the fixing unit 18, is transported toward an ejecting unit 19 in the direction of arrow C. Then, the sheet P is further transported by the ejecting unit 19 in the direction of arrow D and ejected to a sheet-ejection tray 20.

Figure 2:
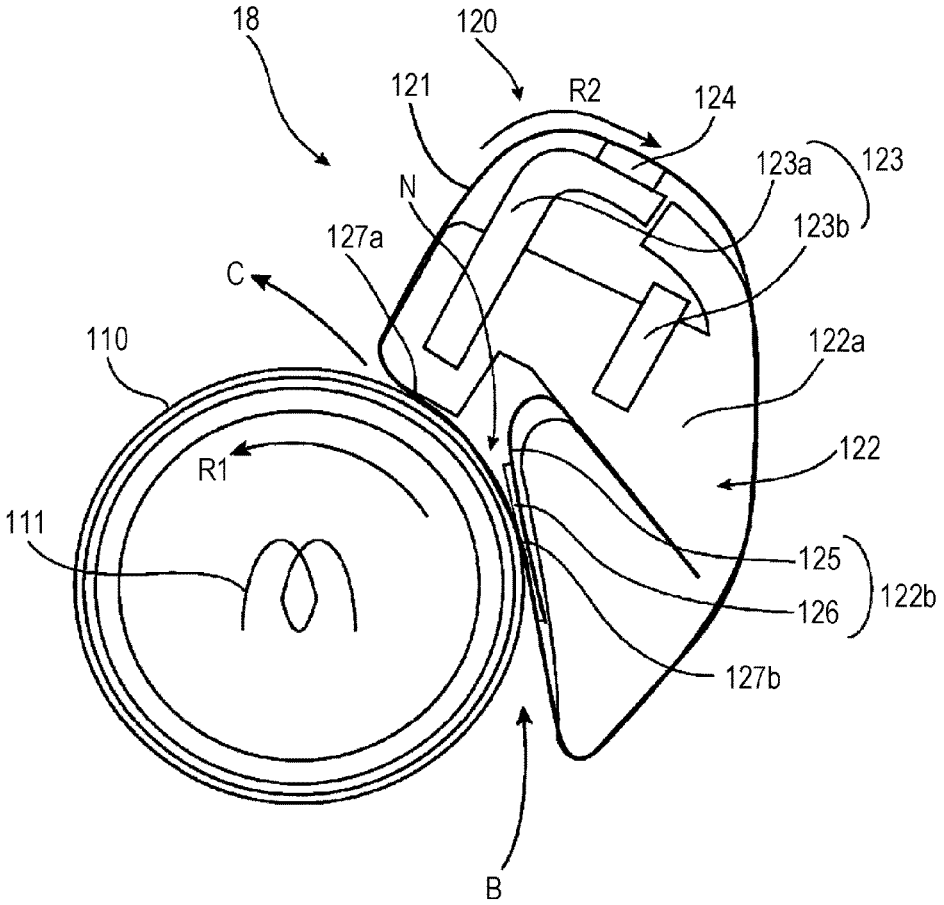
FIG. 2 is a schematic diagram of a fixing unit that is included in the printer illustrated in FIG. 1.

FIG. 2 is a schematic diagram of the fixing unit that is included in the printer illustrated in FIG. 1.

As described above, the fixing unit 18 includes the heating roller 110 and the pressure belt 120. The fixing unit 18 causes one of the sheets P, the sheet P being transported while holding a toner image thereon, to pass through the nip region N by nipping the sheet P between the heating roller 110 and the endless belt 121, which is included in the pressure belt 120, and fixes the toner image formed on the sheet P onto the sheet P by applying heat and pressure to the toner image during the period when the sheet P passes through the nip region N. The heating roller 110 corresponds to an example of a roller member according to the exemplary embodiment of the present invention, and the pressure belt 120 corresponds to an example of a belt member according to the exemplary embodiment of the present invention.

The heating roller 110 has a hollow cylindrical shape and rotates in the direction of arrow R. The heat source 111 is disposed in the heating roller 110 and heats the heating roller 110 from the inside of the heating roller 110 as a result of being supplied with power.

The pressure belt 120 includes the endless belt 121, the pressing member 122, the rotation hindering member 123, and a felt member 124. The pressing member 122, the rotation hindering member 123, and the felt member 124 are disposed in a space enclosed by the endless belt 121.

The endless belt 121 is a member that is pressed against the heating roller 110 and driven so as to rotate in the direction of arrow R2 along with rotation of the heating roller 110 in the direction of arrow R1.

The felt member 124 is impregnated with a lubricating material and serves to apply the lubricating material to the inner surface of the endless belt 121 as a result of rotation of the endless belt 121.

The pressing member 122 is a member that presses the endless belt 121 against the heating roller 110 on both the downstream side (in the vicinity of the end of the nip region N) and the upstream side (in the vicinity of the start of the nip region N) relative to the direction of rotation of the heating roller 110 (direction of arrow R1).

The rotation hindering member 123 presses the pressing member 122 toward the heating roller 110 in such a manner that the endless belt 121 is pressed against the heating roller 110. In addition, the rotation hindering member 123 hinders the pressing member 122 from rotating as a result of receiving a reaction force from the heating roller 110, the reaction force being received by the pressing member 122 as a result of the endless belt 121 being pressed against the heating roller 110.

The pressing member 122 includes a first pressing member 122*a* and a second pressing member 122*b*. The first pressing member 122*a* is a member made of a resin and presses the endless belt 121 against the heating roller 110 at a first pressing position 127*a* on the downstream side (in the vicinity of the end of the nip region N) relative to the direction of rotation of the heating roller 110 (direction of arrow R1). The second pressing member 122*b* is an elastic member formed of a plate spring 125 and a felt material 126 and is supported by the first pressing member 122*a*. The second pressing member 122*b* presses the endless belt 121 against the heating roller 110 at a second pressing position 127*b* on the upstream side (in the vicinity of the start of the nip region N) relative to the direction of rotation of the heating roller 110 (direction of arrow R1). The first pressing member 122*a* presses the endless belt 121 against the heating roller 110 with a relatively large force, and this prevents one of the sheets P, the sheet P being ejected from the nip region N, from being wrapped around the heating roller 110. The second pressing member 122*b* presses the endless belt 121 against the heating roller 110 with a relatively small force by using the elastic member formed of the plate spring 125 and the felt material 126, and this reduces the resistance generated when one of the sheets P enters the nip region N. Each of the first pressing member 122*a* and the second pressing member 122*b* is a member whose length in a direction perpendicular to FIG. 2 is approximately equal to the width of the endless belt 121 in the direction perpendicular to FIG. 2.

Similarly to the pressing member 122, the rotation hindering member 123 includes a first rotation hindering member 123*a* and a second rotation hindering member 123*b* that are respectively disposed on the downstream side and on the upstream side relative to the direction of rotation of the heating roller 110 (direction of arrow R1). Each of the first rotation hindering member 123*a* and the second rotation hindering member 123*b* is a member that extends over the width of the endless belt 121 in the direction perpendicular to FIG. 2 in such a manner that the end portions thereof projecting from the endless belt 121 are supported by a frame (not illustrated).

The first rotation hindering member 123*a* presses the pressing member 122 in a direction in which the pressing member 122 is pressed against the endless belt 121 and also presses the pressing member 122 toward the upstream side in the direction of rotation of the heating roller 110 (direction of arrow R1). The second rotation hindering member 123*b* presses the pressing member 122 in a direction in which the pressing member 122 is pressed against the endless belt 121 and also presses the pressing member 122 toward the downstream side in the direction of rotation of the heating roller 110 (direction of arrow R1). This indicates that the pressing member 122 is nipped by the rotation hindering member 123, which includes the first rotation hindering member 123*a* and the second rotation hindering member 123*b*, from the downstream and upstream sides in the direction of rotation of the heating roller 110 (direction of arrow R1). This structure prevents the pressing member 122 from rotating by a reaction force received by the pressing member 122 and prevents deflection from occurring in the pressing member 122, the deflection being large enough to generate wrinkles in one of the sheets P and cause an image quality defect.

The reason why the rotation hindering member 123 has the above-described structure will now be described with reference to FIG. 3 and FIG. 4.

Figure 3:
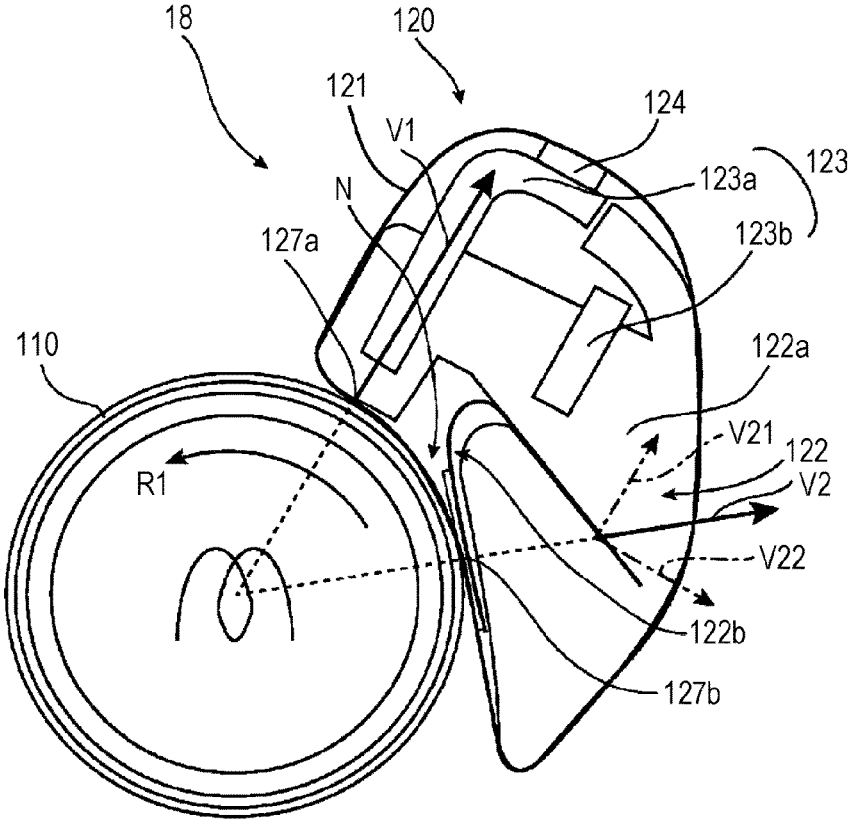
FIG. 3 is a diagram illustrating a fixing unit that is the same as the fixing unit illustrated in FIG. 2 and a reaction force that is received by a pressing member.
Figure 4:
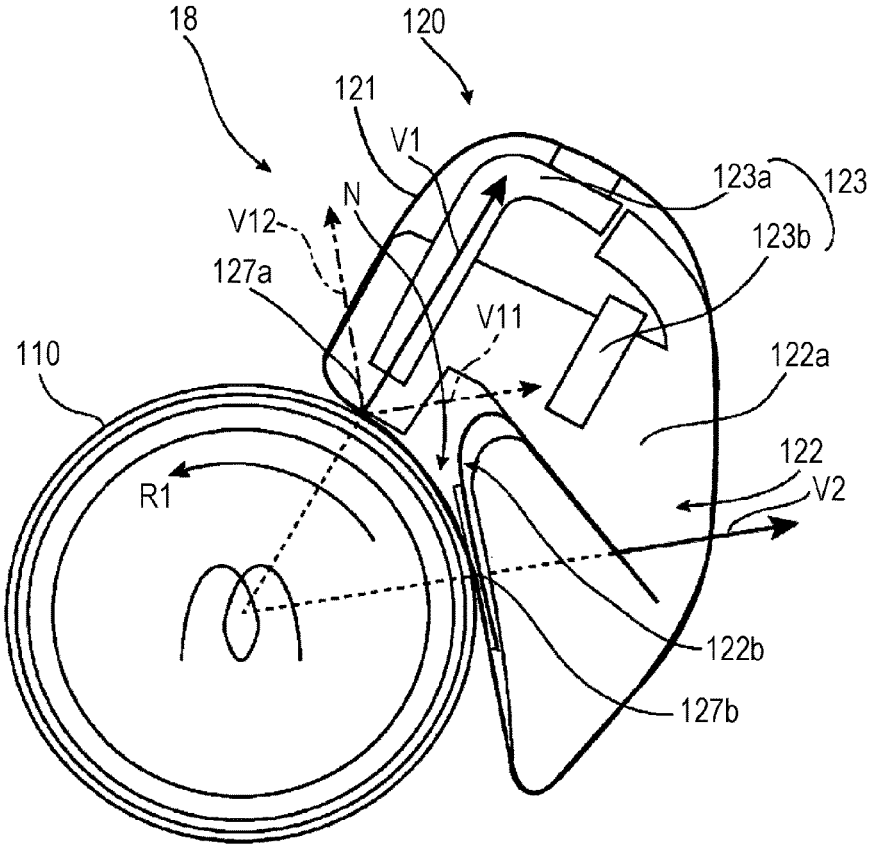
FIG. 4 is a diagram illustrating the fixing unit that is the same as the fixing unit illustrated in FIG. 2 and a reaction force that is received by another pressing member.

FIG. 3 and FIG. 4 are diagrams each illustrating a fixing unit that is the same as the fixing unit illustrated in FIG. 2 and a reaction force that is received by a pressing member. Some of the reference numerals are omitted in order to simplify FIG. 3 and FIG. 4.

As described above, the pressing member 122 includes the first pressing member 122*a*, which is formed of a member made of a resin, and the second pressing member 122*b*, which is formed of an elastic member (the plate spring 125 and the felt material 126 (see FIG. 2)). The first pressing member 122*a* presses the endless belt 121 against the heating roller 110 at the first pressing position 127*a* in the vicinity of the end of the nip region N, and the second pressing member 122*b* presses the endless belt 121 against the heating roller 110 at the second pressing position 127*b* in the vicinity of the start of the nip region N. Therefore, the pressing member 122 receives a reaction force in the direction of a vector V1 at the first pressing position 127*a* and receives a reaction force in the direction of a vector V2 at the second pressing position 127*b*.

The orientation of the vector V1 and the orientation of the vector V2 are different from each other. Here, assume that the vector V2 is decomposed into a component V21 parallel to the orientation of the vector V1 and a component V22 perpendicular to the orientation of the vector V1 as illustrated in FIG. 3. There are the component V21 parallel to the orientation of the vector V1 and the component V22 perpendicular to the orientation of the vector V1. The component V22 perpendicular to the orientation of the vector V1 is a force that tries to move the pressing member 122 toward the upstream side in the direction of rotation of the heating roller 110 (direction of arrow R1). In order to resist this force, the second rotation hindering member 123*b* presses the pressing member 122 toward the downstream side in the direction of rotation of the heating roller 110 (direction of arrow R1).

The reaction force (vector V1) received by the first pressing position 127*a* has been mainly described above with reference to FIG. 3, and the reaction force (vector V2) received by the second pressing position 127*b* will now be mainly described with reference to FIG. 4. Assume that the vector V1 is decomposed into a component V11 parallel to the orientation of the vector V2 and a component V12 perpendicular to the orientation of the vector V2 as illustrated in FIG. 4. There are the component V11 parallel to the orientation of the vector V2 and the component V12 perpendicular to the orientation of the vector V2. The component V12 perpendicular to the orientation of the vector V2 is a force that tries to move the pressing member 122 toward the downstream side in the direction of rotation of the heating roller 110 (direction of arrow R1). In order to resist this force, the first rotation hindering member 123*a* presses the pressing member 122 toward the upstream side in the direction of rotation of the heating roller 110 (direction of arrow R1). That is to say, the pressing member 122 is nipped by the rotation hindering member 123, which includes the first rotation hindering member 123*a* and the second rotation hindering member 123*b*, from the downstream and upstream sides in the direction of rotation of the heating roller 110 (direction of arrow R1). As a result, rotation of the pressing member 122 by a reaction force and deflection of the pressing member 122 is suppressed, so that the position of the pressing member 122 becomes stable, and generation of wrinkles in one of the sheets P that passes through the nip region N and occurrence of an image quality defect due to image irregularities occurred in a toner image on the sheet P may be suppressed.

Note that, although the fixing unit 18, which includes the heating roller 110 and the pressure belt 120, has been described above as an example, the present invention may also be applied to a fixing unit that includes a belt that serves to perform a heating treatment and a roller that serves to perform a pressurizing treatment.

In addition, although a case has been described in which the present invention is applied to the black-and-white printer 10 illustrated in FIG. 1, the present invention may be widely applied to, for example, an image forming apparatus, such as a tandem type color printer, that includes a fixing unit that fixes a toner image formed on a sheet onto the sheet by applying heat and pressure to the toner image.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a roller member that rotates; and a belt member that includes an endless belt that moves circularly while being in contact with the roller member, a pressing member that is disposed in a space enclosed by the endless belt and that presses the endless belt against the roller member on both a downstream side and an upstream side relative to a direction of rotation of the roller member, and a rotation hindering member that is disposed in the space enclosed by the endless belt and that hinders the pressing member from rotating as a result of receiving a reaction force, wherein the rotation hindering member is inserted into the pressing member, and the roller member and the endless belt nip a sheet that has been transported while holding a toner image on the sheet and cause the sheet to pass between the roller member and the endless belt, so that the toner image on the sheet is fixed onto the sheet.

2. The fixing device according to claim 1, wherein the pressing member includes a first pressing member that presses the endless belt against the roller member on the downstream side relative to the direction of rotation of the roller member and a second pressing member that presses the endless belt against the roller member on the upstream side relative to the direction of rotation of the roller member.

3. The fixing device according to claim 2, wherein the first pressing member is a member made of a resin, and the second pressing member is an elastic member.

4. The fixing device according to claim 3, wherein the rotation hindering member includes a first rotation hindering member and a second rotation hindering member that are respectively disposed on the downstream side and on the upstream side relative to the direction of rotation of the roller member, wherein the first rotation hindering member presses the pressing member toward the upstream side in the direction of rotation of the roller member and presses the pressing member in a direction in which the pressing member is pressed against the endless belt, and wherein the second rotation hindering member presses the pressing member toward the downstream side in the direction of rotation of the roller member and presses the pressing member in a direction in which the pressing member is pressed against the endless belt.

5. An image forming apparatus comprising:

the fixing device according to claim 4;

a toner-image forming unit that forms a toner image onto a sheet; and a sheet transport device that transports a sheet along a transport path passing through the toner-image forming unit and the fixing device.

6. An image forming apparatus comprising:

the fixing device according to claim 3;

a toner-image forming unit that forms a toner image onto a sheet; and a sheet transport device that transports a sheet along a transport path passing through the toner-image forming unit and the fixing device.

7. The fixing device according to claim 2, wherein the rotation hindering member includes a first rotation hindering member and a second rotation hindering member that are respectively disposed on the downstream side and on the upstream side relative to the direction of rotation of the roller member, wherein the first rotation hindering member presses the pressing member toward the upstream side in the direction of rotation of the roller member and presses the pressing member in a direction in which the pressing member is pressed against the endless belt, and wherein the second rotation hindering member presses the pressing member toward the downstream side in the direction of rotation of the roller member and presses the pressing member in a direction in which the pressing member is pressed against the endless belt.

8. The fixing device according to claim 7, wherein the rotation hindering member nips the pressing member from two sides in the direction of rotation of the roller member.

9. An image forming apparatus comprising:

the fixing device according to claim 8;

a toner-image forming unit that forms a toner image onto a sheet; and a sheet transport device that transports a sheet along a transport path passing through the toner-image forming unit and the fixing device.

10. An image forming apparatus comprising:

the fixing device according to claim 7;

a toner-image forming unit that forms a toner image onto a sheet; and a sheet transport device that transports a sheet along a transport path passing through the toner-image forming unit and the fixing device.

11. An image forming apparatus comprising:

the fixing device according to claim 2;

a toner-image forming unit that forms a toner image onto a sheet; and a sheet transport device that transports a sheet along a transport path passing through the toner-image forming unit and the fixing device.

12. A fixing device comprising:

a roller member that rotates; and a belt member that includes an endless belt that moves circularly while being in contact with the roller member, a pressing member that is disposed in a space enclosed by the endless belt and that presses the endless belt against the roller member on both a downstream side and an upstream side relative to a direction of rotation of the roller member, and a rotation hindering member that is disposed in the space enclosed by the endless belt and that hinders the pressing member from rotating as a result of receiving a reaction force, wherein the roller member and the endless belt nip a sheet that has been transported while holding a toner image on the sheet and cause the sheet to pass between the roller member and the endless belt, so that the toner image on the sheet is fixed onto the sheet, wherein the rotation hindering member includes a first rotation hindering member and a second rotation hindering member that are respectively disposed on the downstream side and on the upstream side relative to the direction of rotation of the roller member, wherein the first rotation hindering member presses the pressing member toward the upstream side in the direction of rotation of the roller member and presses the pressing member in a direction in which the pressing member is pressed against the endless belt, and wherein the second rotation hindering member presses the pressing member toward the downstream side in the direction of rotation of the roller member and presses the pressing member in a direction in which the pressing member is pressed against the endless belt.

13. An image forming apparatus comprising:

the fixing device according to claim 12;

a toner-image forming unit that forms a toner image onto a sheet; and a sheet transport device that transports a sheet along a transport path passing through the toner-image forming unit and the fixing device.

14. The fixing device according to claim 1, wherein the pressing member presses the endless belt against the roller member with a relatively large force on the downstream side in the direction of rotation of the roller member and presses the endless belt against the roller member with a relatively small force on the upstream side in the direction of rotation of the roller member.

15. An image forming apparatus comprising:

the fixing device according to claim 14;

a toner-image forming unit that forms a toner image onto a sheet; and a sheet transport device that transports a sheet along a transport path passing through the toner-image forming unit and the fixing device.

16. An image forming apparatus comprising:

the fixing device according to claim 1;

a toner-image forming unit that forms a toner image onto a sheet; and a sheet transport device that transports a sheet along a transport path passing through the toner-image forming unit and the fixing device.

17. The fixing device according to claim 1, wherein the rotation hindering member includes a first rotation hindering member and a second rotation hindering member that are respectively disposed on the downstream side and on the upstream side relative to the direction of rotation of the roller member, and wherein both the first rotation hindering member and second rotation hindering member are inserted into the pressing member.

18. An image forming apparatus comprising:

the fixing device according to claim 17;

a toner-image forming unit that forms a toner image onto a sheet; and a sheet transport device that transports a sheet along a transport path passing through the toner-image forming unit and the fixing device.

* * * * *